US009978222B2

(12) United States Patent
Walker

(10) Patent No.: US 9,978,222 B2
(45) Date of Patent: May 22, 2018

(54) GAMING SYSTEM AND A METHOD OF GAMING

(71) Applicant: Aristocrat Technologies Australia Pty Limited, North Ryde (AU)

(72) Inventor: Peter Leslie Walker, Marsfield (AU)

(73) Assignee: Aristocrat Technologies Australia Pty Limited (AU)

( * ) Notice: Subject to any disclaimer, the term of this patent is extended or adjusted under 35 U.S.C. 154(b) by 970 days.

(21) Appl. No.: 14/244,540

(22) Filed: Apr. 3, 2014

(65) Prior Publication Data

US 2014/0302908 A1 Oct. 9, 2014

(30) Foreign Application Priority Data

Apr. 3, 2013 (AU) ..... 2013901147

(51) Int. Cl.
*G07F 17/32* (2006.01)
*G07F 17/34* (2006.01)

(52) U.S. Cl.
CPC ..... *G07F 17/34* (2013.01); *G07F 17/326* (2013.01); *G07F 17/3265* (2013.01); *G07F 17/3262* (2013.01)

(58) Field of Classification Search
CPC .... G07F 17/34; G07F 17/326; G07F 17/3262; G07F 17/3265
See application file for complete search history.

(56) References Cited

U.S. PATENT DOCUMENTS 4,486,017 A 12/1984 Evert
5,560,612 A 10/1996 Ippoliti
6,612,578 B2 * 9/2003 Falciglia, Sr. ..... A63F 3/062 273/269
6,652,377 B1 * 11/2003 Moody ..... A63F 1/00 273/143 R
6,676,512 B2 1/2004 Fong et al.
6,845,980 B2 * 1/2005 Falciglia, Sr. ..... A63F 3/062 273/269
7,195,559 B2 * 3/2007 Gilmore ..... G07F 17/32 273/138.2
7,222,856 B2 5/2007 Dodge
(Continued)

FOREIGN PATENT DOCUMENTS

AU 1021302 8/2002
AU 2003244623 A1 3/2004
(Continued)

*Primary Examiner* — William H McCulloch, Jr.
(74) *Attorney, Agent, or Firm* — McAndrews, Held & Malloy, Ltd.

(57) ABSTRACT

A gaming system is disclosed that comprises a symbol selector arranged to select a plurality of symbols for display in a respective plurality of display positions in a plurality of display position groups, a condition determiner arranged to determine whether a defined condition exists based on the displayed symbols, and a special symbol determiner arranged to determine whether a special symbol is displayed. The gaming system is arranged to add at least one display position to at least one display position group in response to existence of the defined condition. The gaming system is also arranged to cause a particular symbol to be displayed in all display positions of a display position group when the special symbol is displayed in the display position group.

28 Claims, 10 Drawing Sheets

(56) References Cited

U.S. PATENT DOCUMENTS 7,559,840 B1 * 7/2009 D'Avanzo ..... G07F 17/3211 273/138.1
7,578,739 B2 * 8/2009 Gauselmann ..... G07F 17/32 273/138.1
7,654,895 B2 * 2/2010 Pacey ..... G07F 17/3211 273/142 R
7,677,895 B2 3/2010 Miller
8,070,589 B2 12/2011 Macke
8,096,868 B2 * 1/2012 Trainor ..... G07F 17/3244 463/20
8,152,627 B2 * 4/2012 Berman ..... G07F 17/34 463/16
8,177,622 B2 * 5/2012 Englman ..... G07F 17/3265 463/16
8,500,541 B2 * 8/2013 Veenker ..... G07F 17/32 463/16
8,641,503 B2 * 2/2014 Berman ..... G07F 17/3265 463/16
2002/0119814 A1 8/2002 Fong et al.
2005/0029747 A1 2/2005 Grayson
2005/0159208 A1 * 7/2005 Pacey ..... G07F 17/34 463/20
2006/0079313 A1 * 4/2006 Trainor ..... G07F 17/3244 463/20
2006/0113729 A1 6/2006 Dodge
2006/0128456 A1 * 6/2006 Berman ..... G07F 17/3244 463/13
2006/0189375 A1 8/2006 Dodge
2007/0060245 A1 * 3/2007 Veenker ..... G07F 17/32 463/16
2007/0117626 A1 * 5/2007 Castellari ..... G07F 17/32 463/31
2007/0248939 A1 10/2007 Miller
2008/0070668 A1 * 3/2008 Castellari ..... A63F 13/12 463/16
2008/0176620 A1 * 7/2008 Berman ..... G07F 17/3286 463/16
2008/0176634 A1 * 7/2008 Berman ..... G07F 17/34 463/20
2008/0214266 A1 9/2008 Phillips et al.
2009/0239601 A1 9/2009 Macke
2009/0325678 A1 * 12/2009 Gomez ..... G07F 17/34 463/20
2010/0016061 A1 * 1/2010 Gomez ..... G07F 17/34 463/20
2010/0075741 A1 * 3/2010 Aoki ..... G07F 17/3202 463/20
2010/0178976 A1 * 7/2010 Berman ..... G07F 17/34 463/20
2012/0064961 A1 3/2012 Vancura
2013/0072284 A1 * 3/2013 Fong ..... G07F 17/34 463/20
2013/0344939 A1 * 12/2013 Aoki ..... G07F 17/326 463/21
2014/0302908 A1 * 10/2014 Walker ..... G07F 17/34 463/20

FOREIGN PATENT DOCUMENTS

AU 2003244623 B2 2/2006
CN 2882730 Y 3/2007
DK 338682 A 1/1984
DK 147997 B 1/1985
DK 147997 C 7/1985
EP 1378875 A1 1/2004
GB 2222712 A 3/1990
GB 2222712 B 6/1992
GB 2268415 A 1/1994
GB 2353128 A 2/2001
GB 2364418 A 1/2002
GB 2364418 B 5/2004
GB 2353128 B 8/2008
JP 6210052 A 8/1994
JP 7318900 A 12/1995
JP 3167078 B2 5/2001
JP 3345073 B2 11/2002
JP 2003210840 A 7/2003
JP 2004173716 A 6/2004
JP 3788599 B2 6/2006
JP 4295978 B2 7/2009
JP 2011218018 A 11/2011
WO 2005065792 A1 7/2005
WO 2005065792 A8 9/2005
WO 2006028860 A2 3/2006
WO 2006028860 A3 12/2006

* cited by examiner

GAMING SYSTEM AND A METHOD OF GAMING

RELATED APPLICATIONS

This application claims priority to Australian Provisional Patent Application No. 2013901147 having an International filing date of Apr. 3, 2013, which is incorporated herein by reference in its entirety.

FEDERALLY SPONSORED RESEARCH OR DEVELOPMENT

[Not Applicable]

MICROFICHE/COPYRIGHT REFERENCE

[Not Applicable]

BACKGROUND OF THE INVENTION

It is known to provide a gaming system which comprises a game controller arranged to randomly display several symbols from a predetermined set of symbols and to determine a game outcome such as a game win based on the displayed symbols. Such gaming systems may commonly be implemented as a stepper machine provided with reels with each reel carrying several symbols of the set, or a video machine wherein selected symbols are displayed on virtual reels on a graphical display device.

However, while such gaming systems provide users with enjoyment, a need exists for alternative gaming systems in order to maintain or increase player enjoyment.

BRIEF SUMMARY OF THE INVENTION

In accordance with a first aspect of the present invention, there is provided a gaming system comprising:

- a symbol selector arranged to select a plurality of symbols for display in a respective plurality of display positions in a plurality of display position groups;
- a condition determiner arranged to determine whether a defined condition exists based on the displayed symbols; and
- a special symbol determiner arranged to determine whether a special symbol is displayed;
- the gaming system being arranged to add at least one display position to at least one display position group in response to existence of the defined condition; and
- the gaming system being arranged to cause a particular symbol to be displayed in all display positions of a display position group when the special symbol is displayed in the display position group.

In an embodiment, the gaming system comprises a symbol counter arranged to increment a symbol count when a defined symbol is displayed, and the condition determiner is arranged to determine that a defined condition exists when the symbol count reaches a defined number.

In an embodiment, the gaming system is arranged to add at least one display position to each display position group in response to existence of the defined condition.

In an embodiment, each display position group corresponds to a virtual reel, and the gaming system is arranged to add a row of display positions in response to existence of the defined condition such that a display position is added to each reel.

In an embodiment, the gaming system is arranged to add a display position to each display position group in response to existence of a first defined condition, and to add a further display position to each display position group in response to existence of a second defined condition.

The first defined condition may occur when the defined symbol count reaches a first defined number, and the second defined condition may occur when the defined symbol count reaches a second defined number higher than the first defined number.

In an embodiment, the particular symbol is the special symbol such that the gaming system is arranged to cause the special symbol to be displayed in all symbol positions of a symbol position group when the special symbol is displayed in the symbol position group. The special symbol may be a WILD symbol.

In an embodiment, the at least one added display position is partially visible before the at least one display position is added and becomes fully visible after the at least one added display position is added. The at least one added display position may be at least partially obscured by a banner before the at least one display position is added and the banner may be removed after the at least one added display position is added.

In an embodiment, the gaming system comprises an outcome evaluator arranged to determine game outcomes in accordance with defined win lines such that winning outcomes are determined to exist when defined symbols appear along defined win lines.

In an embodiment, the defined win lines are determined based on all win lines that pass through a selected display position group and that meet defined win line criteria outside of the selected display position group. The gaming system may be arranged to facilitate selection of the selected display position group by a user.

In an embodiment, the defined win lines correspond to a default win line that passes across all reels and win lines that correspond to the default win line outside of the selected display position group and all combinations that pass through the selected display position group.

In one embodiment, the gaming system is arranged to operate in normal game mode and special game mode, and the gaming system is arranged to:

- add at least one display position to at least one display position group in response to existence of the defined condition, and/or
- cause a particular symbol to be displayed in all symbol positions of a symbol position group when the special symbol is displayed in the symbol position group,
- only when the gaming system operates in special game mode.

The gaming system may be arranged to commence special game mode when a predetermined game outcome occurs, on the basis of a game event occurring during a game such as display of a particular symbol, in response to player input, based on the amount or type of bet placed, or when a special game is purchased by a player.

The gaming system may be implemented as a stand alone gaming machine or across a network.

In accordance with a second aspect of the present invention, there is provided a method of gaming comprising:

- selecting a plurality of symbols for display in a respective plurality of display positions in a plurality of display position groups;
- determining whether a defined condition exists based on the displayed symbols;
- determining whether a special symbol is displayed;

adding at least one display position to at least one display position group in response to existence of the defined condition; and causing a particular symbol to be displayed in all display positions of a display position group when the special symbol is displayed in the display position group.

In accordance with a third aspect of the present invention, there is provided a computer program arranged when loaded into a computer to instruct the computer to operate in accordance with a gaming system according to the first aspect of the present invention.

In accordance with a fourth aspect of the present invention, there is provided a computer readable medium having computer readable program code embodied therein for causing a computer to operate in accordance with a gaming system according to the first aspect of the present invention.

In accordance with a fifth aspect of the present invention, there is provided a data signal having computer readable program code embodied therein for causing a computer to operate in accordance with a gaming system according to the first aspect of the present invention.

BRIEF DESCRIPTION OF SEVERAL VIEWS OF THE DRAWINGS

The present invention will now be described, by way of example only, with reference to the accompanying drawings, in which.

DETAILED DESCRIPTION OF THE INVENTION

Figure 1:
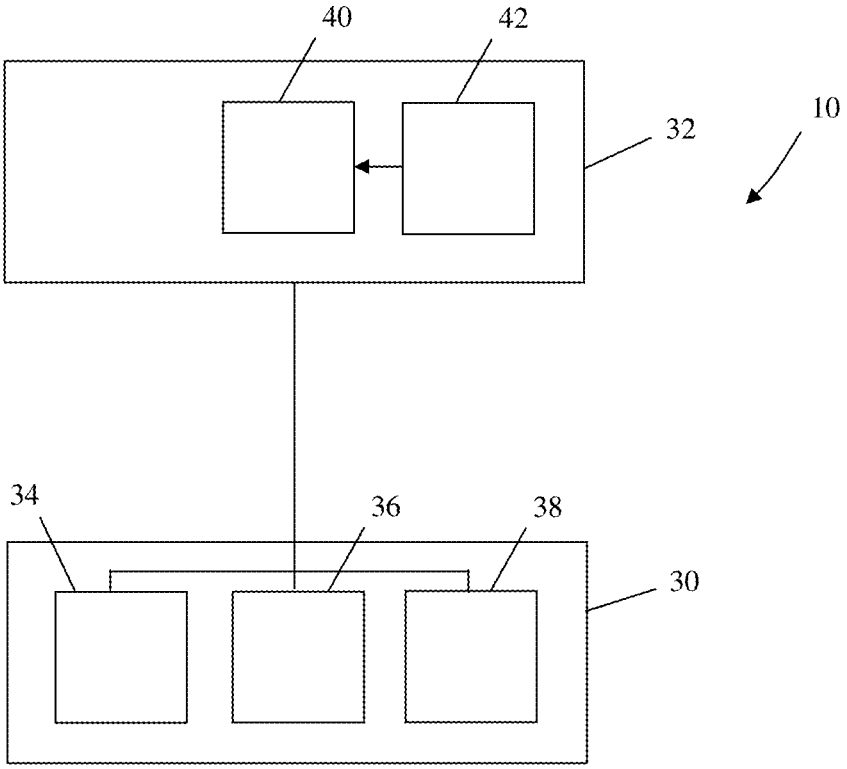
FIG. 1 is a schematic block diagram of core components of a gaming system in accordance with an embodiment of the present invention.

Referring to the drawings, there is shown a schematic block diagram of a gaming system 10 arranged to implement a probabilistic game of the type wherein several symbols from a set of symbols are randomly displayed, and a game outcome is determined on the basis of the displayed symbols. With some such probabilistic games, the set of symbols include standard symbols and function symbols, and the game outcome is determined on the basis of the displayed standard symbols and the function associated with any displayed function symbol. For example, standard symbols may resemble fruit such as apples, pears and bananas with a win outcome being determined when a predetermined number of the same fruit appear on a display in the same line, scattered, and so on. The function associated with a function symbol may be for example a wild function wherein display of the function symbol is treated during consideration of the game outcome as any of the standard symbols. A function symbol may be represented as the word "WILD", a star, or by any other suitable word or symbol. Other functions are also envisaged such as scatter functions, multiplier functions, repeat win functions, jackpot functions and feature commencement functions.

The present gaming system operates such that at least during a portion of a game implemented by the gaming system, the gaming system is arranged to add at least one symbol position to a symbol position group in response to a defined condition occurring during game play, and to cause a particular symbol to be displayed in all symbol positions of a symbol position group when a special symbol is displayed in the symbol position group. In this way, by adding a symbol position to a symbol position group, the likelihood that a special symbol will be displayed in the symbol position group increases and therefore the likelihood that all display positions of the display position group will be changed to the particular symbol increases. In an example, the particular symbol may be a WILD symbol.

Referring to FIG. 1, a schematic diagram of core components of a gaming system 10 is shown. The core components comprise a player interface 30 and a game controller 32. The player interface 30 is arranged to enable interaction between a player and the gaming system and for this purpose includes input/output components required for the player to enter instructions and play the game.

Components of the player interface 30 may vary but will typically include a credit mechanism 34 to enable a player to input credits and receive payouts, one or more displays 36 which may comprise a touch screen, and a game play mechanism 38 arranged to enable a player to input game playing instructions.

The game controller 32 is in data communication with the player interface 30 and typically includes a processor 40 arranged to process game play instructions and output game player outcomes to the display 36. Typically, the game play instructions are stored as program code in a memory 42 that can also be hardwired. It will be understood that in this specification the term "processor" is used to refer generically to any device that can process game play instructions and may include a microprocessor, microcontroller, programmable logic device or other computational device such as a personal computer or a server.

Figure 2:
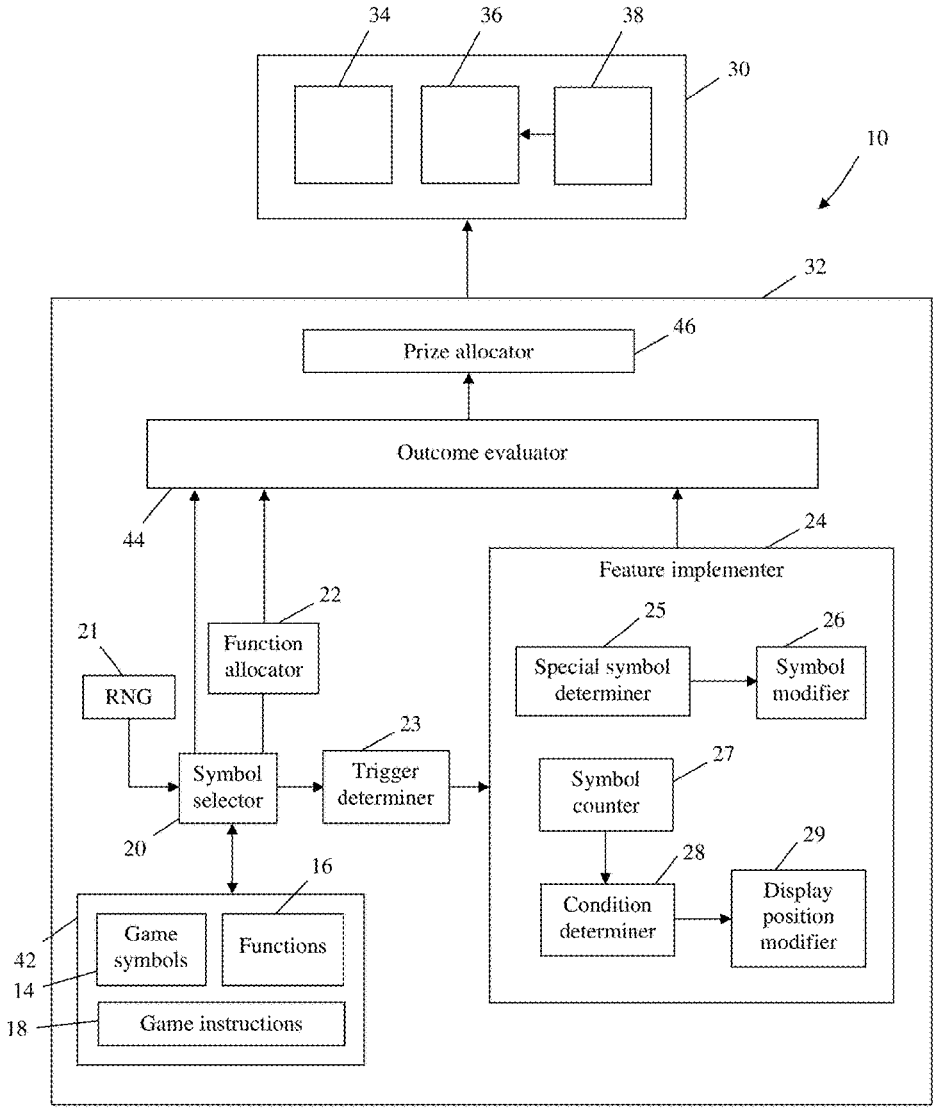
FIG. 2 is a schematic block diagram of functional components of a gaming system in accordance with an embodiment of the present invention.

A functional diagram illustrating operative components of the game controller 32 is shown in FIG. 2.

The memory 42 is arranged to store symbols data 14 indicative of a plurality of symbols for subsequent display to a player, function data 16 indicative of one or more functions allocatable to the symbols, and game instruction data 18 indicative of game instructions usable by the gaming machine 10 to control operation of the game.

The game controller 32 includes a symbol selector 20 which is arranged to select several symbols from the game symbols 14 for display to a player. In this example, the selection carried out by the symbol selector 20 is made using a random number generator 21.

It will be appreciated that the random number generator 21 may be of a type which is arranged to generate pseudo random numbers based on a seed number, and that in this specification the term "random" will be understood accordingly to mean truly random or pseudo random.

In this example, the game controller 32 also comprises a function allocator 22 arranged to select and allocate one or more functions to one or more symbols. Such functions include a wild function, a scatter function, or any other function which may be applied to a symbol or to the game.

The game controller 32 also comprises a trigger determiner 23 arranged to determine whether a trigger condition has occurred during a base game and to instigate a feature game in response to the trigger condition.

The game controller 32 also comprises a feature game implementer 24 arranged to implement a feature game, in this example using the symbol selector 20 to select several symbols from the game symbols 14 for display to a player in a plurality of display positions in a plurality of display position groups. In this example, the plurality of display position groups correspond to visible display positions of a respective plurality of rotatable reels.

The feature implementer 24 also comprises a special symbol determiner 25 arranged to determine whether a special symbol has been selected for display by the symbol selector 20, and in response to display of a special symbol, a symbol modifier 26 causes all symbols in the symbol position group that includes the displayed special symbol to change, for example to special symbols which may be WILD symbols.

The feature implementer 24 also comprises a symbol counter 27 arranged to maintain a count indicative of the number of defined symbols that have been displayed since commencement of the feature game, a condition determiner 28 arranged to determine whether the count maintained in the symbol counter 27 has reached a defined number, and a display position modifier 29 arranged to add one or more display positions to one or more display position groups when the count maintained in the symbol counter 27 reaches the defined number. In one example, 2 numbers are defined and the display position modifier 29 is arranged to add one display position to each display position group when the count maintained by the symbol counter 27 reaches a first defined number and to add a further display position to each display position group when the count maintained by the symbol counter 27 reaches a second defined number.

The game controller 32 also comprises an outcome evaluator 44 which in accordance with the game instructions 18 determines game outcomes based on the symbols selected for display to a player by the symbol selector 20 during a base game and during a feature game. Also included is a prize allocator 46 arranged to allocate prizes to a player that correspond to winning outcomes determined by the outcome evaluator 44.

In the embodiments described below, the symbol selector 20, the function allocator 22, the trigger determiner 23, the feature game implementer 24, the special symbol determiner 25, the symbol modifier 26, the symbol counter 27, the condition determiner 28, the display position modifier 29, the outcome evaluator 44 and the prize allocator 46 are at least partly implemented using the processor 40 and associated software, although it will be understood that other implementations are envisaged.

The gaming system 10 can take a number of different forms.

In a first form, a stand alone gaming machine is provided wherein all or most components required for implementing the game are present in a player operable gaming machine.

In a second form, a distributed architecture is provided wherein some of the components required for implementing the game are present in a player operable gaming machine and some of the components required for implementing the game are located remotely relative to the gaming machine. For example, a "thick client" architecture may be used wherein part of the game is executed on a player operable gaming machine and part of the game is executed remotely, such as by a gaming server; or a "thin client" architecture may be used wherein most of the game is executed remotely such as by a gaming server and a player operable gaming machine is used only to display audible and/or visible gaming information to the player and receive gaming inputs from the player.

However, it will be understood that other arrangements are envisaged. For example, an architecture may be provided wherein a gaming machine is networked to a gaming server and the respective functions of the gaming machine and the gaming server are selectively modifiable. For example, the gaming system may operate in stand alone gaming machine mode, "thick client" mode or "thin client" mode depending on the game being played, operating conditions, and so on. Other variations will be apparent to persons skilled in the art.

Figure 3:
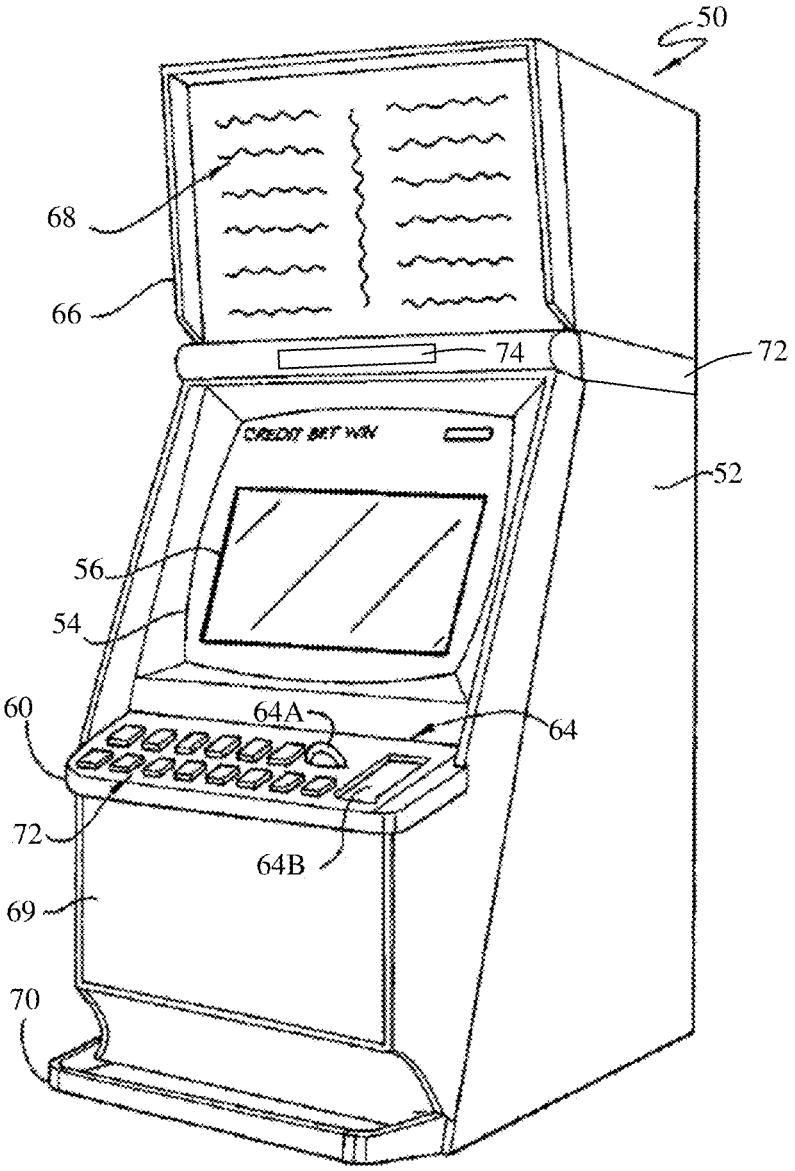
FIG. 3 is a diagrammatic representation of a gaming system in accordance with an embodiment of the present invention with the gaming system implemented in the form of a stand alone gaming machine.

A gaming system in the form of a stand alone gaming machine 50 is illustrated in FIG. 3. The gaming machine 50 includes a console 52 having a display 54 on which is displayed representations of a game 56 that can be played by a player. A mid-trim 60 of the gaming machine 50 houses a bank of buttons 72 for enabling a player to interact with the gaming machine, in particular during game play. The mid-trim 60 also houses a credit input mechanism 64 which in this example includes a coin input chute 64A and a bill collector 64B. Other credit input mechanisms may also be employed, for example, a card reader for reading a smart card, debit card or credit card. A reading device may also be provided for the purpose of reading a player tracking device, for example as part of a loyalty program. The player tracking device may be in the form of a card, flash drive or any other portable storage medium capable of being read by the reading device.

A top box 66 may carry artwork 68, including for example pay tables and details of bonus awards and other information or images relating to the game. Further artwork and/or information may be provided on a front panel 69 of the console 52. A coin tray 70 is mounted beneath the front panel 59 for dispensing cash payouts from the gaming machine 50.

The display 54 is in the form of a video display unit, particularly a cathode ray tube screen device. Alternatively, the display 54 may be a liquid crystal display, plasma screen, or any other suitable video display unit. The top box 66 may also include a display, for example a video display unit, which may be of the same type as the display 54, or of a different type.

The display 54 in this example is arranged to display representations of several reels, each reel of which has several associated symbols. Typically 3, 4 or 5 reels are provided. During operation of a game, the reels first appear to rotate then stop with typically three symbols visible on each reel. Game outcomes are determined on the basis of the visible symbols together with any special functions associated with the symbols, and if a function has been allocated to a reel, on the basis of the allocated function.

Figure 4:
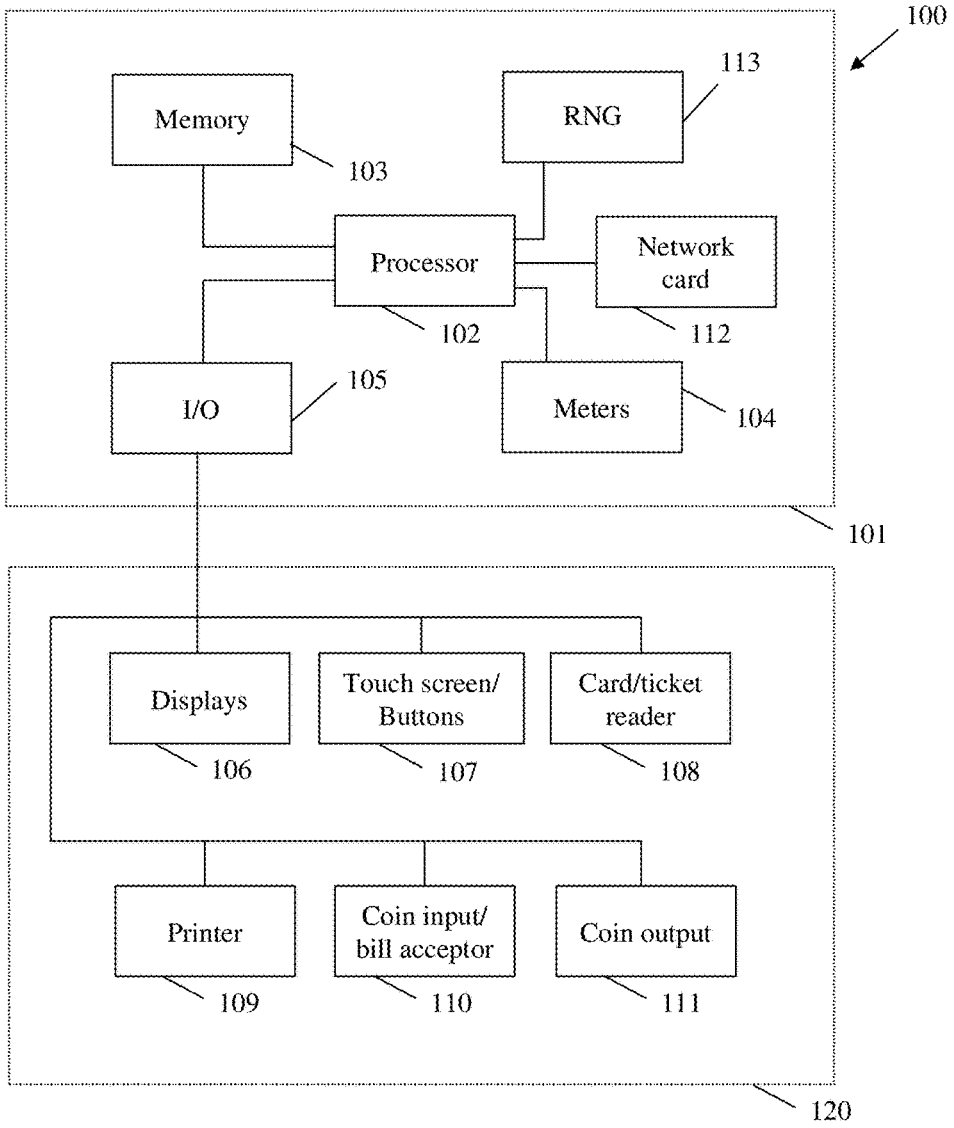
FIG. 4 is a schematic block diagram of operative components of the gaming machine shown in FIG. 3.

FIG. 4 shows a block diagram of operative components of a typical gaming machine 100 which may be the same as or different to the gaming machine shown in FIG. 3.

The gaming machine 100 includes a game controller 101 having a processor 102. Instructions and data to control operation of the processor 102 in accordance with the present invention are stored in a memory 103 which is in data communication with the processor 102.

Typically, the gaming machine 100 will include both volatile and non-volatile memory and more than one of each type of memory, with such memories being collectively represented by the memory 103.

Figure 5:
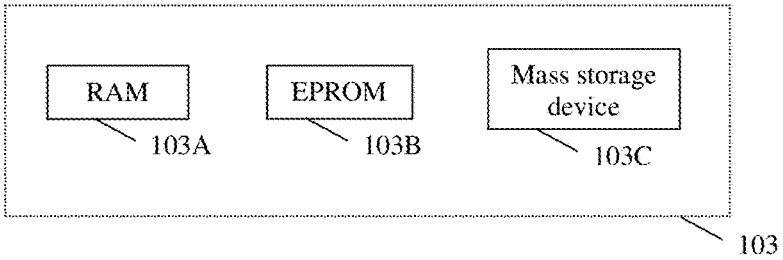
FIG. 5 is a schematic block diagram of components of a memory of the gaming machine shown in FIG. 3.

FIG. 5 shows a block diagram of the main components of an exemplary memory 103. The memory 103 includes RAM 103A, EPROM 103B and a mass storage device 103C. The RAM 103A typically temporarily holds program files for execution by the processor 102 and related data. The EPROM 103B may be a boot ROM device and/or may contain some system or game related code. The mass storage device 103C is typically used to store game programs, the integrity of which may be verified and/or authenticated by the processor 102 using protected code from the EPROM 103B or elsewhere.

The gaming machine has hardware meters 104 for purposes including ensuring regulatory compliance and monitoring player credit, an input/output (I/O) interface 105 for communicating with a player interface 120 of the gaming machine 100, the player interface 120 having several peripheral devices. The input/output interface 105 and/or the peripheral devices may be intelligent devices with their own memory for storing associated instructions and data for use with the input/output interface or the peripheral devices. A random number generator module 113 generates random numbers for use by the processor 102.

In the example shown in FIG. 4, the peripheral devices that communicate with the game controller 101 comprise one or more displays 106, a touch screen and/or bank of buttons 107, a card and/or ticket reader 108, a printer 109, a bill acceptor and/or coin input mechanism 110 and a coin output mechanism 111. Additional hardware may be included as part of the gaming machine 100, or hardware may be omitted as required for the specific implementation.

In addition, the gaming machine 100 may include a communications interface, for example a network card 112. The network card may, for example, send status information, accounting information or other information to a central controller, server or database and receive data or commands from the central controller, server or database.

It is also possible for the operative components of the gaming machine 100 to be distributed, for example input/output devices 106, 107, 108, 109, 110, 111 may be provided remotely from the game controller 101.

Figure 6:
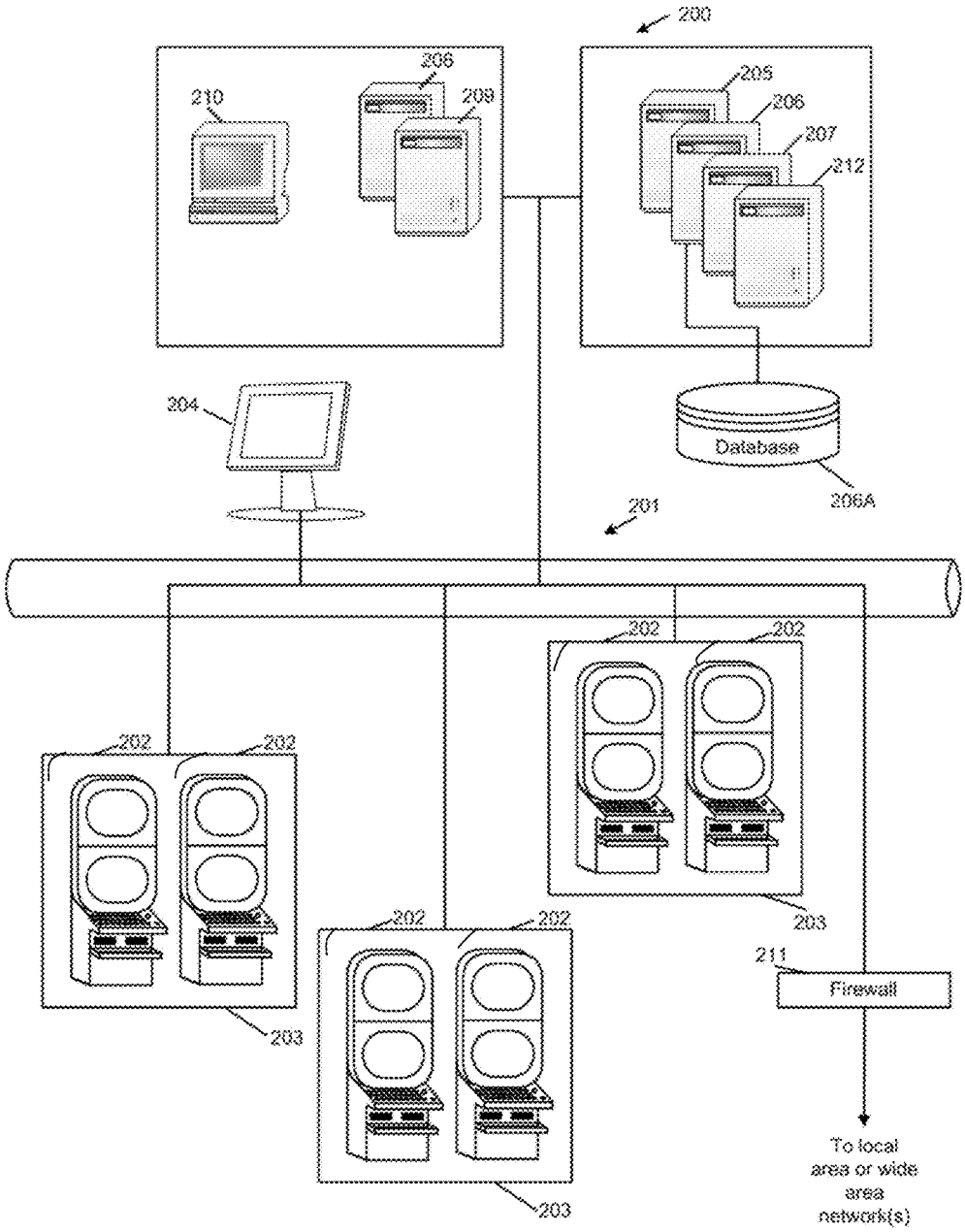
FIG. 6 is a schematic diagram of a gaming system in accordance with an alternative embodiment of the present invention with the gaming system implemented over a network.

FIG. 6 shows a gaming system 200 in accordance with an alternative embodiment. The gaming system 200 includes a network 201, which for example may be an Ethernet network, a LAN or a WAN. In this example, three banks 203 of two gaming machines 202 are connected to the network 201. The gaming machines 202 provide a player operable interface and may be the same as the gaming machines 40,100 shown in FIGS. 3 and 4, or may have simplified functionality depending on the requirements for implementing game play. While banks 203 of two gaming machines are illustrated in FIG. 6, banks of one, three or more gaming machines are also envisaged.

One or more displays 204 may also be connected to the network 201. The displays 204 may, for example, be associated with one or more banks 203 of gaming machines. The displays 204 may be used to display representations associated with game play on the gaming machines 202, and/or used to display other representations, for example promotional or informational material.

In a thick client embodiment, a game server 205 implements part of the game played by a player using a gaming machine 202 and the gaming machine 202 implements part of the game. With this embodiment, as both the game server 205 and the gaming machine 202 implement part of the game, they collectively provide a game controller. A database management server 206 may manage storage of game programs and associated data for downloading or access by the gaming devices 202 in a database 206A. Typically, if the gaming system enables players to participate in a Jackpot game, a Jackpot server 207 will be provided to monitor and carry out the Jackpot game.

In a variation of the above thick client embodiment, the gaming machine 202 may implement the game, with the game server 205 functioning merely to serve data indicative of a game to the gaming machine 202 for implementation.

With this implementation, a data signal containing a computer program usable by the client terminal to implement the gaming system may be transferred from the game server to the client terminal, for example in response to a request by the client terminal.

In a thin client embodiment, the game server 205 implements most or all of the game played by a player using a gaming machine 202 and the gaming machine 202 essentially provides only the player interface. With this embodiment, the game server 205 provides the game controller. The gaming machine will receive player instructions, and pass the instructions to the game server which will process them and return game play outcomes to the gaming machine for display. In a thin client embodiment, the gaming machines could be computer terminals, e.g. PCs running software that provides a player interface operable using standard computer input and output components.

Servers are also typically provided to assist in the administration of the gaming system 200, including for example a gaming floor management server 208 and a licensing server 209 to monitor the use of licenses relating to particular games. An administrator terminal 210 is provided to allow an administrator to monitor the network 201 and the devices connected to the network.

The gaming system 200 may communicate with other gaming systems, other local networks such as a corporate network, and/or a wide area network such as the Internet, for example through a firewall 211.

A loyalty program server 212 may also be provided.

Persons skilled in the art will appreciate that in accordance with known techniques, functionality at the server side of the network may be distributed over a plurality of different computers. For example, elements may be run as a single "engine" on one server or a separate server may be provided. For example, the game server 205 could run a random number generator engine. Alternatively, a separate random number generator server could be provided.

During operation, the game controller, whether implemented in a stand alone gaming machine 10, 44, 100 or over a network 201, implements a probabilistic game wherein at least during part of the game the gaming system is arranged to add at least one symbol position to a symbol position group in response to a defined condition occurring during game play, and to cause a particular symbol to be displayed in all symbol positions of a symbol position group when a special symbol is displayed in the symbol position group.

Examples of specific implementations of the gaming system will now be described in relation to a stand alone gaming machine 10, 44, 100 although it will be understood that implementation may also be carried out using other gaming system architectures such as a network architecture of the type shown in FIG. 6.

In the present example, the gaming system is operable in normal game mode and special game mode.

During normal game mode, a base game is implemented wherein reels comprising standard symbols and optionally one or more function symbols are provided. Win outcomes are determined on the basis of the symbols visible when the reels stop rotating, and in this example five reels are provided with three symbols visible on each reel at any time. A win outcome may occur based on display of the same symbol along a horizontal or diagonal line, as scattered symbols, or in any other predefined way. A win outcome may also occur on the basis of one or more standard symbols in combination with at least one function symbol having a predetermined assigned function. For example a function symbol may correspond to a wild function, a scatter function, a multiply function, a repeat win function, and so on.

During special game mode, a feature game is implemented by the feature implementer 24.

In the present example, game outcomes are determined in accordance with defined win lines such that winning outcomes are determined to exist when defined symbols appear along defined win lines. The defined win lines are determined, at least in part, by selecting, for example by a user, one or more reels and defining the win lines as all win lines that pass through the selected reel and that meet defined win line criteria outside of the selected reel. For example, a default win line that passes centrally across all reels may be provided and additional win lines added by selecting one or more reels, with the additional win lines corresponding to the default win line outside of the selected reel(s) and all combinations that pass through the selected reel(s).

The gaming system may be arranged to commence special game mode when a predetermined game outcome occurs during a base game, and special game mode may comprise one or more free games, in this example five free games. Special game mode may commence automatically on the basis of a game event occurring during a game such as display of one or more particular symbols, based on game outcomes determined by the gaming system, or may be prompted by a player pressing a button on the gaming system 10, 44, 100 after the player has identified that a game outcome corresponding to special game mode requirements has occurred.

The gaming system 10, 44, 100 may also be arranged so as to determine eligibility for special game mode, for example based on the amount or type of bet placed, based on certain time periods and so on.

Special game mode may also be arranged to commence when a special game is purchased by a player.

Figure 7:
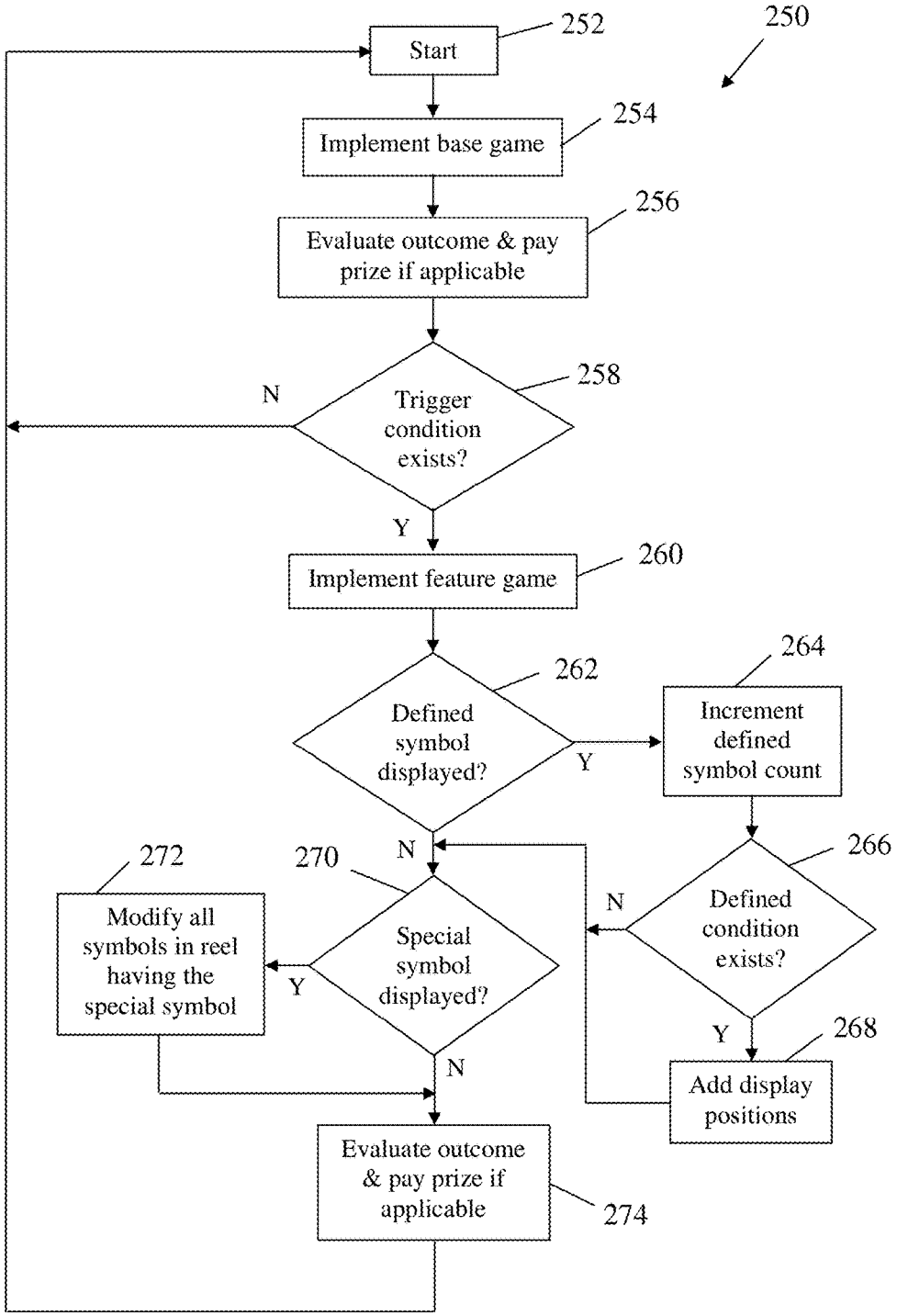
FIG. 7 is a flow diagram illustrating game play of a gaming system in accordance with an embodiment of the present invention.

A specific example will now be described in relation to flow diagram 250 shown in FIG. 7 which illustrates steps 252 to 274 of a method of gaming implemented by the gaming system according to the present embodiment.

Example representations shown on the display device 54 during implementation of a game are shown in FIGS. 8 to 12.

In this example, five reels 304, 306, 308, 310, 312 are provided, with each reel having multiple symbols. The reels are virtual reels and, as such, representations of the reels are displayed on a graphical display device 54. The gaming system 10, 44, 100 is operable in normal game mode and special game mode.

Figure 8:
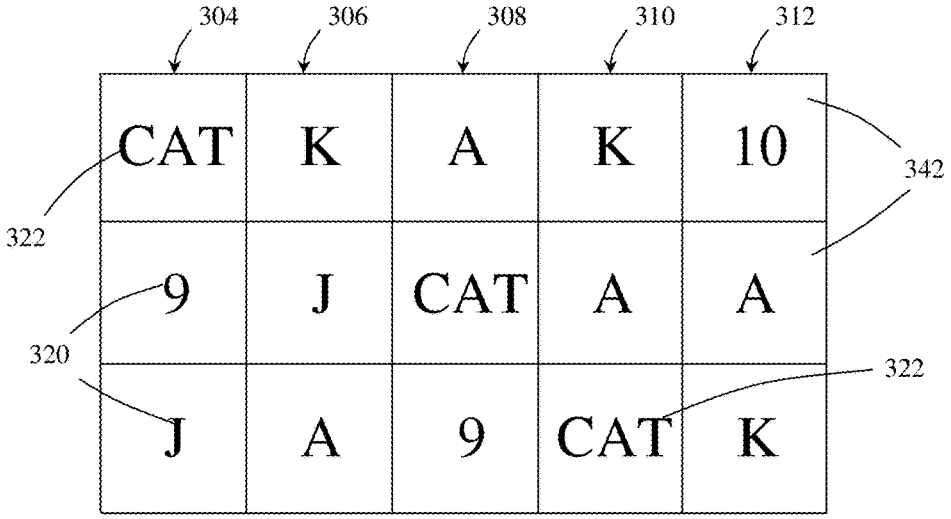
FIGS. 8 to 12 are diagrammatic representations of example displayed symbols of a gaming system in accordance with an embodiment of the present invention during use.

During normal game mode, a base game is implemented 254 wherein the reels 304, 306, 308, 310, 312 are spun and subsequently stopped with 3 symbols 320 displayed on each reel, as shown in FIG. 8. The displayed symbols are then evaluated and a prize is awarded if applicable 256.

When a predetermined trigger condition occurs during a base game, for example based on occurrence of a predetermined game outcome, by a player pressing a button after the player has identified that requirements for special game mode have been met, or in any other way, the gaming system 10, 44, 100 implements special game mode. Commencement of special game mode may be communicated to a player in any suitable way, for example by displaying an icon on the graphical display.

Figure 9:
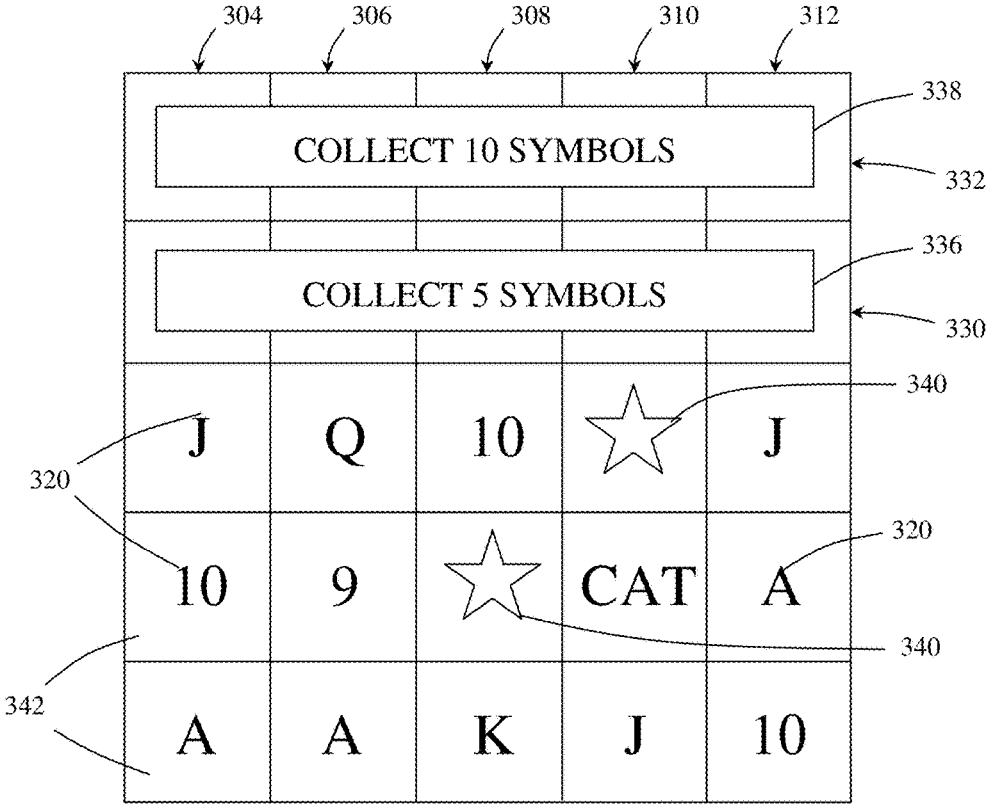

In the present example, a trigger condition comprises display of scattered CAT symbols 322, as shown in FIG. 8. When special game mode commences, a feature game is implemented 260 wherein the reels 304, 306, 308, 310, 312 are spun and subsequently stopped with 3 symbols 320 displayed on each reel, as shown in FIG. 9. As shown in FIG. 9, an additional 2 rows 330, 332 have been added, although each of these additional rows 330, 332 is covered by a respective banner 336, 338 and is not currently in play. In the present embodiment, symbols present in the additional row(s) are at least partially still visible to a user.

Figure 11:
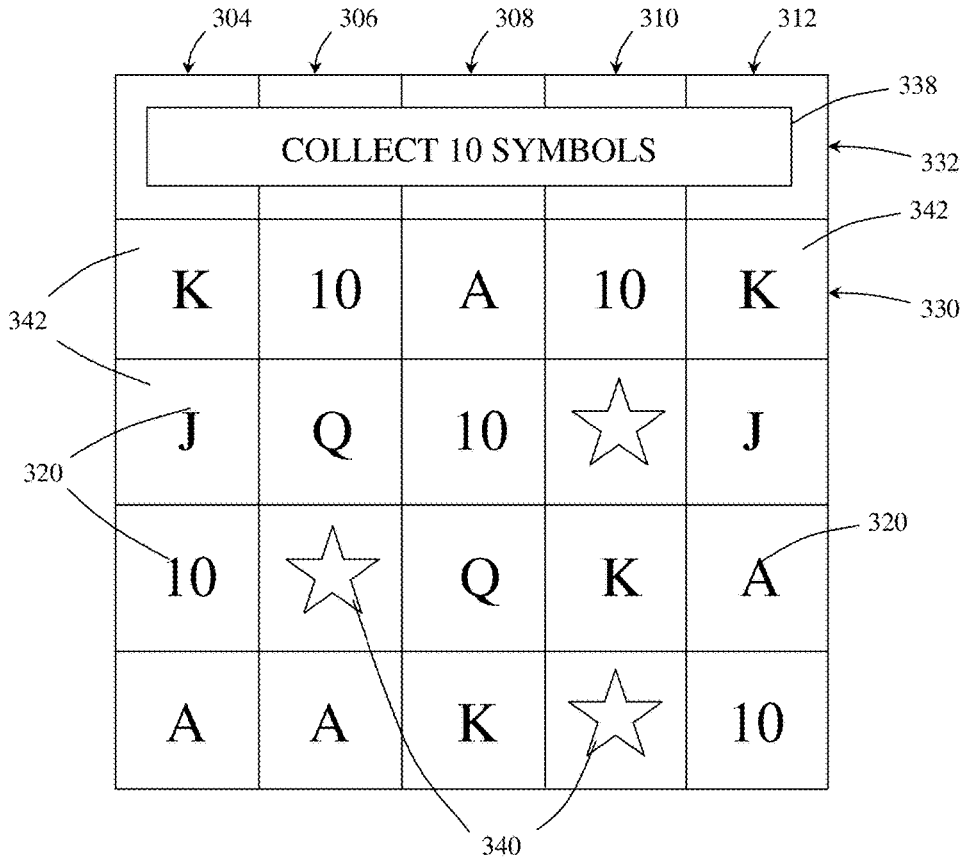

During the feature games, at least one symbol is identified as a defined symbol 340 and for each defined symbol 340 that appears on the display, a symbol count maintained by the symbol counter 27 is incremented 264. If the symbol count reaches a defined first count number, in this example 5, a defined first condition is determined to exist 266 and a first additional row 330 is added to game play, in this example by removing the first banner 336, so that each reel 304, 306, 308, 310, 312 includes an additional display position 342, as shown in FIG. 11. As a consequence, 4 symbols are now visible and in play on each of the reels 304, 306, 308, 310, 312.

Figure 12:
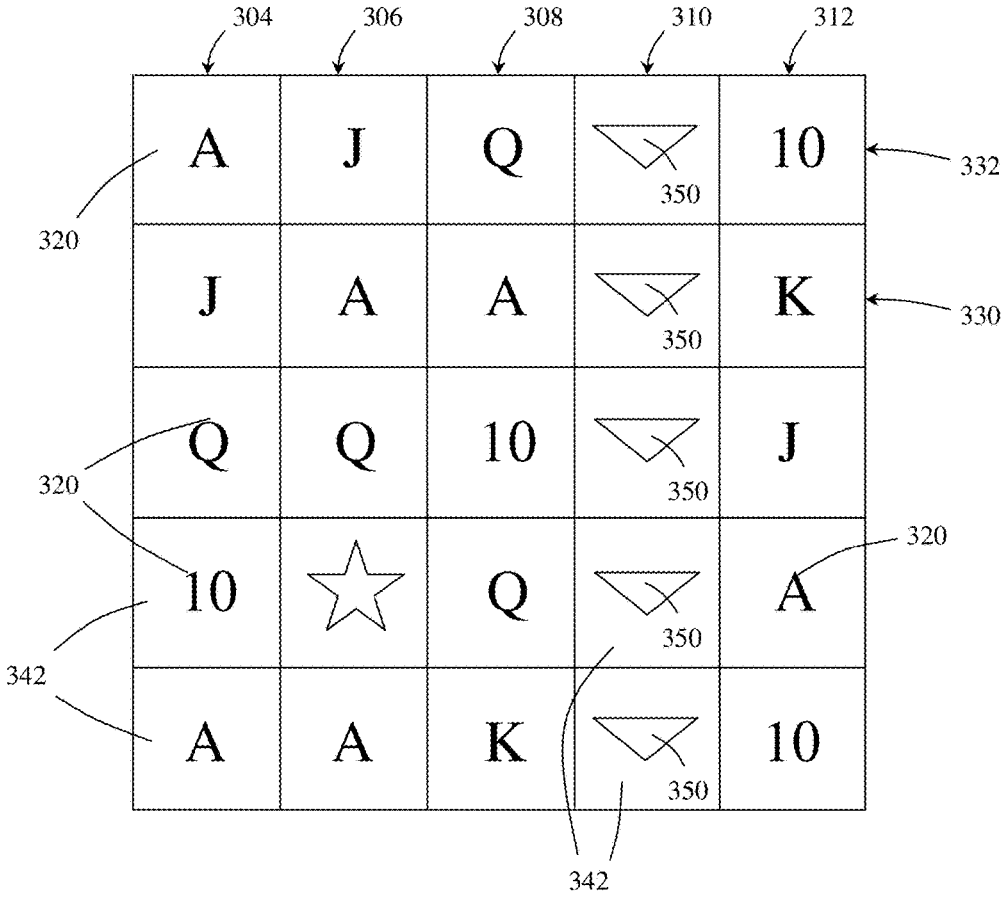

If the symbol count reaches a defined second count number, in this example 10, a defined second condition is determined to exist 266 and a second additional row 332 is added, in this example by removing the second banner 338, so that each reel 304, 306, 308, 310, 312 includes a further additional display position 342, as shown in FIG. 12. As a consequence, 5 symbols are now visible and in play on each of the reels 304, 306, 308, 310, 312.

Figure 10:
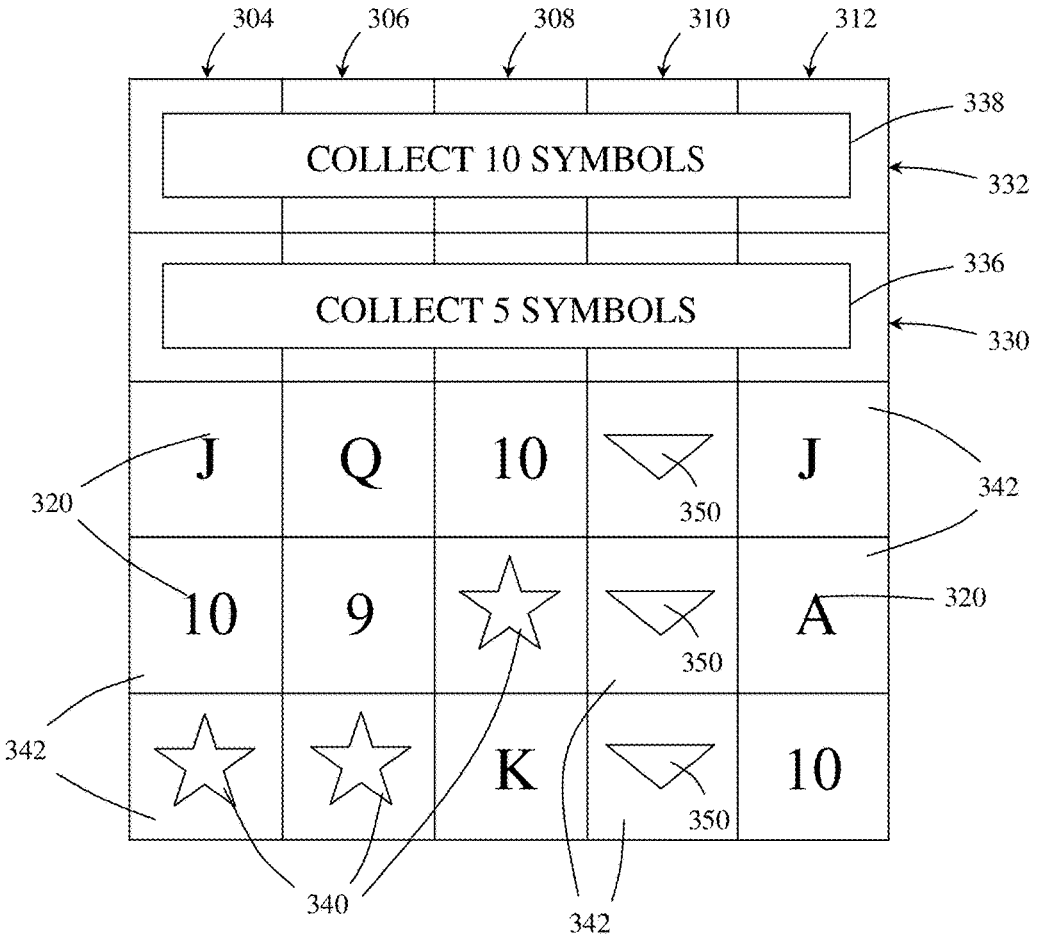

Also during the feature game, if a special symbol 350 appears on the display, the symbol modifier 26 modifies the symbols displayed on the reel in which the special symbol appears so that each display position 342 of the reel shows a special symbol 350, as shown in FIGS. 10 and 12. In this example, the special symbol 350 is a WILD symbol.

It will be appreciated that if additional display positions are added, in this example by adding rows to the display positions currently in play, the likelihood of a special symbol appearing on the display and therefore the likelihood that an entire reel will include special symbols increases.

After each feature game, the outcome generator 28 evaluates the displayed symbol combination and if the symbols correspond to a win outcome a prize is awarded.

It will also be appreciated that since in the present example winning outcomes are determined, at least in part, according to one or more selected reels wherein win lines are defined as all win lines that pass through the selected reel and that meet defined win line criteria, by adding one or more display positions to a selected reel, the number of available win lines increases.

Modifications and variations as would be apparent to a skilled addressee are deemed to be within the scope of the present invention.

The invention claimed is:

1. A gaming machine comprising:

a credit input mechanism configured to receive a physical item representing a monetary value for establishing a credit balance, the credit balance being increasable and decreasable based at least on wagering activity;

credit meters configured to monitor the credit balance;

a display having a plurality of display positions including a first group of display positions, a second group of display positions, and a third group of display positions;

a memory storing a plurality of symbols including a first special symbol and a second special symbol;

a game controller having:

a symbol selector configured to, in response to the wagering activity, select from said memory a plurality of symbols for display;

a display controller configured to display a first plurality of the selected symbols in the first group of display positions, to display a second plurality of the selected symbols in the second group of display positions, to display a third plurality of the selected symbols in the third group of display positions, and to display a cover over the second plurality of the selected symbols in the second group of display positions;

a condition determiner configured to determine whether a defined condition exists based on the symbols displayed in the first group of display positions; and a special symbol determiner configured to determine whether the first special symbol is displayed in the first group of display positions and whether the second special symbol is displayed in the third group of display positions; and wherein the game controller is configured to uncover the second group of display positions to reveal the selected symbols displayed in the second group of display positions in response to 1) the condition determiner determining that the defined condition exists and 2) the special symbol determiner determining the first special symbol is displayed in the first group of display positions, to display a plurality of second special symbols in the third group of display positions in response to the special symbol determiner determining that the second special symbol is displayed in a display position of the third group of display positions, and to determine whether a winning combination exists in at least one of the first group, the second group and the third group of display positions; and a prize allocator configured to, in response to determining a winning combination exists, increase the credit balance.

2. The gaming machine as claimed in claim 1, further comprising a symbol counter configured to increment a symbol count when the first special symbol is displayed, wherein the condition determiner is further configured to determine that the defined condition exists when the symbol count reaches a defined number.

3. The gaming machine as claimed in claim 1, wherein the third group of display positions corresponds to a virtual reel, and the game controller is further configured to uncover the selected symbols in the second group of display positions such that a display position is added to the virtual reel.

4. The gaming machine as claimed in claim 1, wherein the defined condition is a first defined condition, the display includes a fourth group of display positions, and the display controller is further configured to display a second cover over a third plurality of the selected symbols in the fourth group of display positions, wherein the game controller is further configured to uncover the selected symbols in the fourth group of display positions in response to the condition determiner determining that a second defined condition exists.

5. The gaming machine as claimed in claim 4, wherein the first defined condition occurs when a defined symbol count reaches a first defined number, and the second defined condition occurs when the defined symbol count reaches a second defined number higher than the first defined number.

6. The gaming machine as claimed in claim 1, wherein the game controller is further configured to cause the second special symbol to be displayed in all symbol positions of the third group of display positions when the second special symbol is displayed in the third group of display positions.

7. The gaming machine as claimed in claim 6, wherein the second special symbol is a WILD symbol.

8. The gaming machine as claimed in claim 1, wherein the second group of display positions is partially visible before the second group of display positions is uncovered and becomes fully visible after the second group of display positions is uncovered.

9. The gaming machine as claimed in claim 8, wherein the cover is a banner and the game controller is further configured to remove the banner when the second group of display positions display the plurality of second special symbols.

10. The gaming machine as claimed in claim 1, further comprising an outcome evaluator configured to determine game outcomes in accordance with defined win lines such that winning outcomes are determined to exist when defined symbols appear along defined win lines.

11. The gaming machine as claimed in claim 10, wherein the defined win lines are determined based on all win lines that pass through a selected display position group and that meet defined win line criteria outside of the selected display position group.

12. The gaming machine as claimed in claim 11, further comprising an interface configured to facilitate a selection of the selected display position group by a user.

13. The gaming system as claimed in claim 11, wherein the display comprises a plurality of reels, and wherein the defined win lines correspond to a default win line that passes across the plurality of reels and win lines that correspond to the default win line outside of the selected display position group and all combinations that pass through the selected display position group.

14. The gaming system as claimed in claim 1, wherein the game controller is further operable to commence a special game mode when a predetermined game outcome occurs, on the basis of a game event occurring during a game such as display of a particular symbol, in response to player input, based on an amount or type of bet placed, or when a special game is purchased by a player.

15. A method of gaming for use with a gaming machine having a credit input mechanism configured to receive a physical item representing a monetary value for establishing a credit balance, the credit balance being increasable and decreasable based at least on wagering activity, credit meters operable to monitor the credit balance, a memory storing a plurality of symbols including a first special symbol and a second special symbol, a display having a plurality of display positions including a first group of display positions, a second group of display positions, and a third group of display positions, a payout mechanism, and a game controller, the method comprising:

selecting from said memory, in response to the wagering activity, a plurality of symbols for display;

displaying a first plurality of the selected symbols in the first group of display positions a second plurality of the selected symbols in the second group of display positions, a third plurality of the selected symbols in the third group of display positions, and a cover over the second plurality of the selected symbols in the second group of display positions;

determining via the game controller whether a defined condition exists based on the symbols displayed in the first group of display positions;

determining via the game controller whether the first special symbol is displayed in the first group of display positions and whether the second special symbol is displayed in the third group of display positions;

causing the display to display an uncovering of the second group of display positions to reveal the selected symbols displayed in the second group of display positions in response to determining that 1) the defined condition exists and 2) the first special symbol is displayed in the first group of display positions; and causing the third group of display positions to display a plurality of second special symbols in response to determining that the second special symbol is displayed in a display position of the third group of display positions;

determining via the game controller whether a winning combination exists in at least one of the first group, the second group and the third group of display positions; and in response to determining a winning combination exists, increasing the credit balance.

16. The method as claimed in claim 15, further comprising incrementing a symbol count when the first special symbol is displayed, and determining that the defined condition exists when the symbol count reaches a defined number.

17. The method as claimed in claim 16, wherein the first defined condition occurs when a defined symbol count reaches a first defined number, and the second defined condition occurs when the defined symbol count reaches a second defined number higher than the first defined number.

18. The method as claimed in claim 15, wherein the third group of display positions corresponds to a virtual reel, and the method comprises causing the display to uncover the selected symbols in the second group of display positions such that a display position is added to the virtual reel.

19. The method as claimed in claim 15, wherein the defined condition is a first defined condition, the display includes a fourth group of display positions, and the display controller is further configured to display a second cover over a third plurality of the selected symbols in the fourth group of display positions, further comprising causing the display to display an uncovering of the selected symbols in the fourth group of display positions in response to determining that a second defined condition exists.

20. The method as claimed in claim 15, further comprises causing the second special symbol to be displayed in all symbol positions of the third group of display positions when the second special symbol is displayed in the third group of display positions.

21. The method as claimed in claim 20, wherein the second special symbol is a WILD symbol.

22. The method as claimed in claim 15, wherein the second group of display positions is partially visible before the second group of display positions is uncovered and becomes fully visible after the second group of display positions is uncovered.

23. The method as claimed in claim 22, wherein the cover is a banner, the method further comprising removing the banner when the second group of display positions display the plurality of second special symbols.

24. The method as claimed in claim 15, comprising determining game outcomes in accordance with defined win lines such that winning outcomes are determined to exist when defined symbols appear along defined win lines.

25. The method as claimed in claim 24, wherein the defined win lines are determined based on all win lines that pass through a selected display position group and that meet defined win line criteria outside of the selected display position group.

26. The method as claimed in claim 25, comprising facilitating selection of the selected display position group by a user.

27. The method as claimed in claim 25, wherein the display comprises a plurality of reels, and wherein the defined win lines correspond to a default win line that passes across the plurality of reels and win lines that correspond to the default win line outside of the selected display position group and all combinations that pass through the selected display position group.

28. The method as claimed in claim 15, further comprising commencing a special game mode when a predetermined game outcome occurs, on the basis of a game event occurring during a game such as a display of a particular symbol, in response to player input, based on an amount or type of bet placed, or when a special game is purchased by a player.

* * * * *